United States Patent [19]

Robinson et al.

[11] Patent Number: 4,865,086

[45] Date of Patent: Sep. 12, 1989

[54] METHOD OF TWISTING THE CONDUCTORS OF ELECTRICAL WIRES

[75] Inventors: William M. Robinson, Palo Alto; Michele B. Small, Mountain View, both of Calif.

[73] Assignee: Raychem Corporation, Menlo Park, Calif.

[21] Appl. No.: 231,124

[22] Filed: Aug. 11, 1988

[51] Int. Cl.[4] ..... B21F 15/04

[52] U.S. Cl. ..... 140/118; 140/149

[58] Field of Search ..... 140/118, 119, 149

[56] References Cited

U.S. PATENT DOCUMENTS

| | | | |
|---|---|---|---|
| 1,845,951 | 2/1932 | Worsham | 140/119 |
| 2,687,752 | 8/1954 | Diggs | 140/119 |
| 2,739,623 | 3/1956 | Wirt | 140/149 |
| 3,333,609 | 8/1967 | Fielding | 140/119 |

FOREIGN PATENT DOCUMENTS

| | | | |
|---|---|---|---|
| 1482751 | 8/1977 | United Kingdom | 140/149 |

*Primary Examiner*—Lowell A. Larson

*Attorney, Agent, or Firm*—Herbert G. Burkard; Simon J. Belcher

[57] ABSTRACT

The invention provides a method of twisting the conductors of one or more electrical wires, the method comprising:

(a) assembling the conductors into a bundle;

(b) inserting the bundle of conductors into a wire twister which comprises an elongate body having an axially extending cavity formed therein, the cavity being open at one end and having a substantially closed cross-section with four sides, at least one of the sides of the cavity being inclined to the axis of the body so that the cavity is tapered inwardly away from the open end, the ratio of the length of the longest side to the length of the shortest side at the axial position at which the conductors, when twisted to form a substantially circular array, contact two opposite sides of the cavity being from about 1.0 to about 3.0; and (c) imparting rotation to the wire twister relative to the conductors, while maintaining the conductors in contact with at least two of the sides of the cavity.

18 Claims, 2 Drawing Sheets

FIG 3
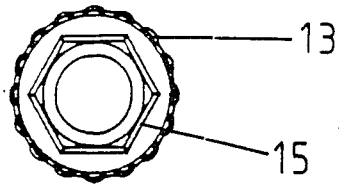
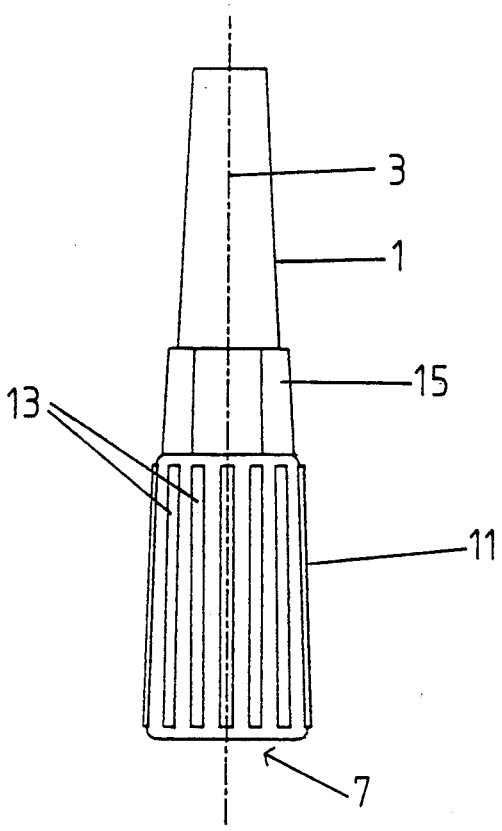
FIG 1
FIG 2
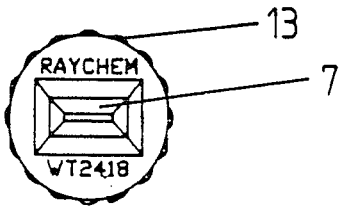

METHOD OF TWISTING THE CONDUCTORS OF ELECTRICAL WIRES

BACKGROUND TO THE INVENTION

This invention relates to a method of twisting the conductors of one or more electrical wires, particularly when the conductors are multi-stranded, by means of a wire twister.

A wire twister is known for assembly with a rotary drive unit. The known twister comprises two plates which are in contact along one edge that is disposed perpendicular to the axis of rotation of the twister. The plates are disposed so that they extend away from the said edge at an angle to the axis of rotation, to define a space between the plates which, when viewed in lateral cross-section, is triangular. In use, the stripped conductors of electrical wires are inserted between the plates. The wire twister is caused to turn at speeds of up to about 3400 revolutions per minute (RPM), and friction between the rotating plates and the inserted conductors causes the conductors to twist with one another. Such a wire twister is sold by the Carpenter Manufacturing Company Limited of Manluis, NY 13104, USA, under the trade name Model 25C Rotary Wire Twister.

The high speed with which the known wire twister rotates makes it difficult to control the amount of twist that is imparted to the conductors, with the result that the helix angle of the wound conductors is undesirably large. (The helix angle is the angle between a tangent to the helix and the axis of the helix). A large helix angle is undesirable since the free ends of the twisted conductors have an increased tendency to splay outwardly. This can make more difficult the insertion of the twisted conductors into an aperture.

SUMMARY OF THE INVENTION

We have devised a wire twister which enables conductors to be twisted with more control to produce conductors that are twisted with a smaller helix angle than has hitherto been possible, and a method of twisting conductors using the wire twister.

Accordingly, the invention provides a method of twisting the conductors of one or more electrical wires, the method comprising:

(a) assembling the conductors into a bundle;

(b) inserting the bundle of conductors into a wire twister which comprises an elongate body having an axially extending cavity formed therein, the cavity being open at one end and having a substantially closed cross-section with four sides, at least one of the sides of the cavity being inclined to the axis of the body so that the cavity is tapered inwardly away from the open end, the ratio of the length of the longest side to the length of the shortest side at the axial position at which the conductors, when twisted to form a substantially circular array, contact two opposite sides of the cavity being from about 1.0 to about 3.0; and (c) imparting rotation to the wire twister relative to the conductors, while maintaining the conductors in contact with at least two of the sides of the cavity.

The wire twister used in the method of the invention has the advantage that it is able to twist the conductors of one or more, especially two, wires at low speed, and that at such low speed, the amount of twist imparted to the conductors can be controlled. In particular, the helix angle of the conductors can be kept small, preferably less than 45°, more preferably less than 30°.

Preferably, the wire twister is twisted through from about 270° to about 900°, more preferably from about 360° to about 720°.

It has been found that the advantageous properties of the twister arise from the cavity being defined by four walls so that it has four sides and a substantially closed cross-section. By substantially closed cross-section is meant that the cavity is not open along an edge as is the previously known twister, whose cavity is defined by two plates. It may have axially extending openings in the form of, for example, a slot or a slit in or between any of the four sides, for example resulting from the process by which the body is formed, such as by folding a sheet of foldable material.

While a four sided cavity has been found to possess advantageous properties, it has been found that the sides need not be precisely defined. For example, the cavity may have rounded corners between the sides, or internal fillets may be provided in the corners between pairs of the sides.

Preferably the cavity in the twister is substantially rectangular in cross-section. This has the advantage that when more than one wire has to be inserted in the cavity, the wires can be positioned side-by-side for insertion. Once the conductors have been inserted, rotation of the wire twister can cause twisting of the conductors.

Satisfactory twisting of the conductors of the wires can generally be achieved if the ratio of the length of the longest side of the cavity to the length of the shortest side is from about 0.1 to about 3.0. Preferably the ratio is from about 1.5 to about 2.0, in order to obtain sufficient twisting of the conductors at low speeds of rotation of the wire twister.

The ratio of the lengths of the sides of the cavity is measured at the axial position in the cavity at which the conductors, when twisted to form a substantially circular array, contact two opposite sides of the cavity and can be inserted no further into the cavity. The axial position is thus dependent on the diameter of the array. The diameter of a circular array of circular objects is given by the formula:

$$D = d\left[0.94 - \frac{(N-3.7)^{\frac{1}{2}}}{(0.907)}\right]$$

where $D$ is the diameter of the circular array, $d$ is the diameter of each object in the array, and $N$ is the number of objects.

When the conductors to be twisted are of single conductor wires, or are of one multi-conductor wire, each of the objects is a conductor.

When the conductors to be twisted are of two or more multi-conductor wires, each object again is a conductor. However, the value of D obtained in practice does not equal the value (D′) predicted by the formula because, to some extent, the conductors are held in bundles defined by the original wires. If the wires remained circular and unaffected by the twisting of the conductors, the value D″ would be obtained by using the diameter of the conductors of one wire for d, and the number of wires for N. It has been found that the diameter D of a bundle of conductors of a plurality of multiconductor wires is given approximately by:

$$D = 0.7D' + 0.3D''$$

This weighted value for D takes into account the fact that, to some extent, the bundled formation of the conductors, defined by the original wires, is not completely destroyed.

The cavity in the wire twister is tapered inwardly away from its open end, as a result of at least one of the sides of the cavity being inclined to the axis of the body. This allows wires to be inserted further progressively as they are twisted. Preferably each of a pair of opposite sides of the cavity are so inclined to the axis of the body, the opposite sides being the longer sides of the cavity when it is rectangular. It is especially preferred that all of the sides of the cavity are so inclined to the axis of the body.

Preferably the angle between the or each inclined side of the body, and the axis of the body, is from about 2° to 10°, especially from about 4° to about 6°. It has been found that angles within these ranges, especially in the narrow range, offer an advantageous combination of ability to twist the wires and low insertion force.

It will generally be preferred that the end of the cavity, towards which the cavity is tapered, is closed, for optimum shaping of the twisted conductors.

Preferably the wire twister includes means which facilitates gripping of the twister to allow rotational movement to be imparted. Preferably the grip means is formed in the outer surface of the body. For example a portion of the outer surface of the body may be textured, for example by the provision of axially extending ribs or by being knurled.

As an alternative or in addition to a portion of the surface of the body being textured, grip means may be provided by a portion of the body which has a non-circular cross-section in a plane perpendicular to the axis of the body. The non-circular portion may be gripped manually, or more preferably by means of a tool. Preferably the cross-section of the non-circular portion of the body is hexagonal.

Preferably a portion of the cavity at the open end thereof is flared outwardly. This has the advantage that it facilitates insertion of conductors into the cavity. When the cavity is tapered inwardly away from its open end, the flare can be provided by a more marked taper at the open end.

The material of the body of the wire twister is selected according to the nature of the conductors to be twisted. Preferably the material of the body is such that the conductors are not damaged unacceptably by abrasive forces when they are twisted, in particular such that any plating on the conductors is not scraped away.

The material of the wire twister, at least that from which the walls of the cavity are made, preferably has a hardness of at least 85, more preferably at least 100, on the Rockwell R scale measured according to ASTM D-785. Preferably the material of the wire twister, at least that from which the walls of the cavity are made, has a hardness no greater than 150 on the Rockwell R scale.

The wire twister may be made from a metal. Preferably, however, the body of the wire twister comprises a polymeric material. This has the advantages that the twister is lighter and less expensive. In particular, a twister made from the use of techniques such as casting or molding has the added advantage that it is possible to make twisters in which the surface of the cavity is smooth. This facilitates twisting of conductors, and minimizes damage to the material of the conductors caused by, for example, abrasive forces when the conductors are twisted. Polymeric material can be made by relatively inexpensive processes such as casting or molding.

Thermoplastic and thermoset polymeric materials may be used depending on the requirements of the twister and on the process used for its manufacture. The properties of materials may be modified to suit requirements by use of appropriate additives, such as fillers and the like.

Suitable polymeric materials include:

polyphenylene sulphide polyphenylene sulphide, reinforced with 40% by weight (based on the total weight of polymer and filler) of chopped glass fibers nylon 6:6, reinforced with a particulate filler such as 10 to 40% by weight, especially 20% by weight, of glass spheres.

polyvinyl chloride a blend of an acrylonitrile/butadiene/styrene copolymer (ABS) with a polycarbonate a blend of ABS with polyvinylchloride an epoxy resin, reinforced with about 40% by weight of silica In some circumstances, it may be advantageous to make the wire twister in more than one part, for example so that the cavity is defined by a liner made from a material which is appropriate for the application to which the twister is to be put, for example depending on the material, number and size of the conductors to be twisted.

The cross-sectional dimensions of the cavity will be selected according to the number and sizes of conductors to be twisted. For example in a first embodiment of wire twister, the cavity will have a cross-section at its open end of about 4×2.5 mm. In a second embodiment, the cavity will have a cross-section at its open end of about 5.8×3.5 mm. In a third embodiment, the cavity will have a cross-section at its open end of about 7.9×4.8 mm. The sides of the cavity may be inclined to the axis of the body. The angle of inclination of one of the pairs of opposite sides is preferably greater than the angle of inclination of the other pair of opposite sides, more preferably from about 1° to about 4° greater, especially about 2° greater. Preferably, when the cavity is substantially rectangular, the longer pair of sides is inclined at the larger angle to the axis. For example the shorter pair of sides may be inclined at 5° to the axis, and the longer pair at 7° to the axis. The body of the twister may include a lead-in portion at the open end of the cavity, so that the sides of the cavity are inclined at an angle of from about 30° to 60° over a depth of about 2 to 4 mm. In the embodiments described above, the cross-sectional areas of the cavity are measured at the base of the lead-in portion of the twister body.

The wire twister of the invention may include means for imparting rotational movement to the body. For example, the body may be attached to a power drive, although it is preferred that the drive be a low speed drive to allow the degree of twist imparted to the conductors to be controlled. A drive speed of less than about 150 RPM is preferred. Alternatively, the body may be attached to a tool which gives rise to rotational movement as a result of being squeezed manually.

The wire twister used in the present method may be formed as part of another tool, for example in a moulded handle of a tool such as a screwdriver.

BRIEF DESCRIPTION OF THE DRAWINGS

FIG. 1 is an elevational view of a wire twister according to the invention;

FIG. 2 is a view of one end of the wire twister shown in FIG. 1;

FIG. 3 is a view of the other end of the wire twister shown in FIG. 1; and

DESCRIPTION OF A PREFERRED EMBODIMENT

Figure 4:
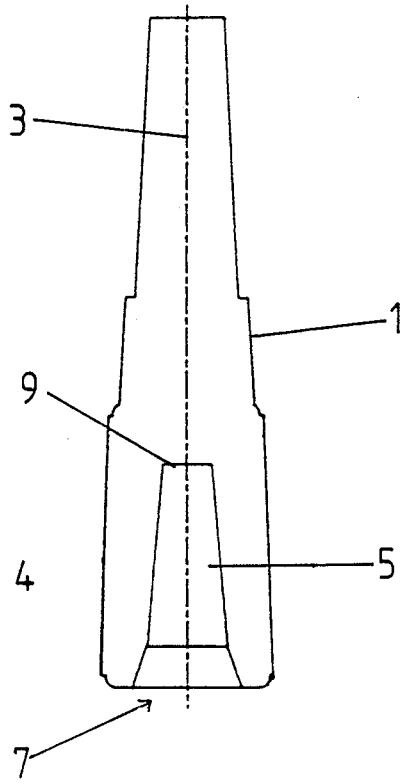
FIG. 4 is a sectional elevation of the wire twister shown in FIGS. 1 to 3, the section being taken in the plane of the paper.

The drawings show a wire twister which comprises an elongate body 1 having an axis 3 and an axially extending cavity 5. One end 7 of the cavity is open (the end depicted in FIG. 2) and the other end 9 of the cavity is closed (the end depicted in FIG. 3).

The cavity 5 is rectangular, being defined by four walls, each of which is inclined to the axis of the body, so that the cavity is tapered inwardly towards its closed end 9. The angle between each of the walls of the cavity and the axis is about 5°.

A portion 11 of the outer surface of the body 1 is provided with axially extending ribs 13 which allow the body to be gripped manually for rotational motion to be imparted to the body.

A portion 15 of the body 1 has a cross-section which is hexagonal to allow the body to be gripped by a tool.

The cavity 5 is flared outwardly at its open end 7 to facilitate insertion of conductors to be twisted into the cavity.

What is claimed is:

1. A method of twisting the conductors of one or more electrical wires, the method comprising:

(a) assembling the conductors into a bundle;

(b) inserting the bundle of conductors into a wire twister which comprises an elongate body having an axially extending cavity formed therein, the cavity being open at one end and having a substantially closed cross-section with four sides, and at least one of the sides of the cavity being inclined to the axis of the body so that the cavity is tapered inwardly away from the open end, the ratio of the length of the longest side to the length of the shortest side at the axial position at which the conductors, when twisted to form a substantially circular array, contact two opposite sides of the cavity being from about 1.0 to about 3.0, the bundle being so inserted that its end contacts two opposite sides of the cavity at a point therein at which the cavity is so tapered; and (c) imparting rotation to the wire twister relative to the bundle of conductors, while maintaining the end of the bundle in contact with at least two of the sides of the cavity.

2. A method as claimed in claim 1, in which the rotation is through from about 270° to about 900°.

3. A method as claimed in claim 1, in which the cavity of the twister is substantially rectangular in cross-section.

4. A method as claimed in claim 1, in which the value of the said ratio is from about 1.5 to about 2.0.

5. A method as claimed in claim 1, in which the angle between the inclined side of the twister cavity and the axis of the body is from about 2° to 10°.

6. A method as claimed in claim 5, in which the said angle is from about 4° to about 8°.

7. A method as claimed in claim 1, in which each of a pair of opposite sides of the cavity are so inclined to the axis of the body.

8. A method as claimed in claim 1, in which all of the sides of the cavity are so inclined to the axis of the body.

9. A method as claimed in claim 8, in which the angle at which one pair of opposite sides of the cavity are inclined to the axis of the body is from about 1° to about 4° greater than the angle at which the other pair of opposite sides are inclined to the said axis.

10. A method as claimed in claim 9, in which the cavity of the twister is substantially rectangular, and in which the pair of longer sides is inclined at a greater angle to the axis of the body than the pair of shorter sides.

11. A method as claimed in claim 1, in which the twister includes means which facilitates gripping of the twister to allow rotational movement to be imparted to the twister.

12. A method as claimed in claim 11, in which the grip means comprises a portion of the outer surface of the body which is textured.

13. A method as claimed in claim 11, in which the grip means comprises a portion of the body which has a non-circular cross-section in a plane perpendicular to the axis of the body.

14. A method as claimed in claim 13, in which the cross-section of the non-circular portion of the body is hexagonal.

15. A method as claimed in claim 1, in which a portion of the twister cavity at the open end thereof is flared outwardly.

16. A method as claimed in claim 1, in which the body of the twister is formed form a material having a hardness of at least about 85 on the Rockwell R scale.

17. A method as claimed in claim 16, in which the hardness of the said material is less than about 150 on the Rockwell R scale.

18. A method as claimed in claim 1, in which the body of the twister comprises a polymeric material.

* * * * *